United States Patent [19]

Kuntz et al.

[11] Patent Number: 4,981,654

[45] Date of Patent: Jan. 1, 1991

[54] UNITARY CENTRIFUGE TUBE AND SEPARABLE DISPENSING RECEPTACLE

[75] Inventors: David H. Kuntz; Louis F. Muller, both of Los Angeles, Calif.

[73] Assignee: Davstar Industries, Inc., Newport Beach, Calif.

[21] Appl. No.: 191,202

[22] Filed: May 6, 1988

[51] Int. Cl.[5] ..... B01L 3/00

[52] U.S. Cl. ..... 422/102; 422/100; 422/72; 436/177

[58] Field of Search ..... 422/72, 73, 101, 102, 422/100; 436/70, 177; 356/36; 494/16, 20; 435/30, 296

[56] References Cited

U.S. PATENT DOCUMENTS 3,750,645 8/1973 Bennett et al. .
3,814,522 6/1974 Clark et al. .
3,914,985 10/1975 von Behrens .
4,066,414 1/1978 Selby .

FOREIGN PATENT DOCUMENTS 1031641 6/1966 United Kingdom .

*Primary Examiner*—Robert J. Warden
*Assistant Examiner*—D. John Griffith, Jr.
*Attorney, Agent, or Firm*—Henry M. Bissell

[57] ABSTRACT

A unitary centrifuge tube and separable sediment dispenser comprises a generally tubular portion with a conical taper connected by a short tube to a sediment receptacle. The receptacle is designed to be easily separated from the centrifuge tube by twisting the receptacle and centrifuge tube with respect to each other. A short segment of the connecting tube which remains attached to the sediment receptacle allows convenient dispensing of the enclosed sediment by squeezing two opposed walls of the container. A second pair of opposed transverse sidewalls is designed to resist flexing during the separation.

14 Claims, 1 Drawing Sheet

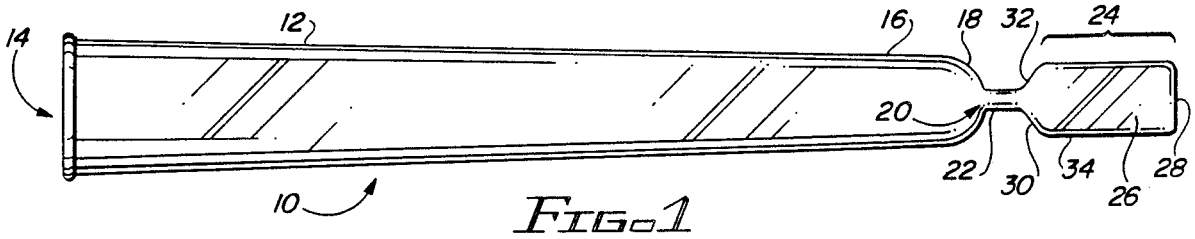
FIG. 1
FIG. 2
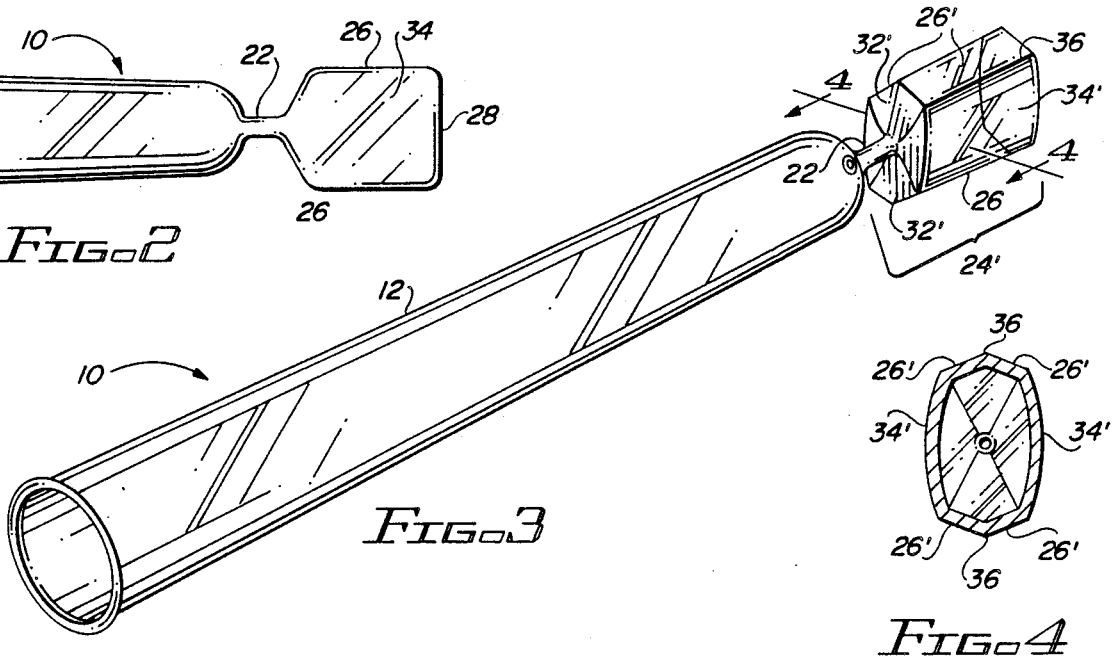
FIG. 3
FIG. 4
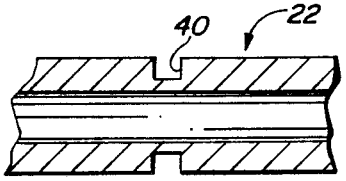
FIG. 5A
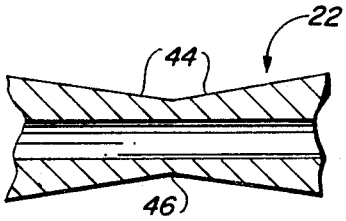
FIG. 5B
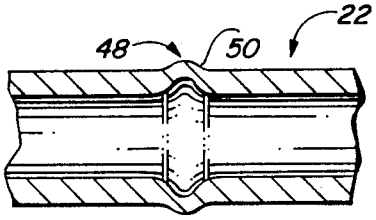
FIG. 5C
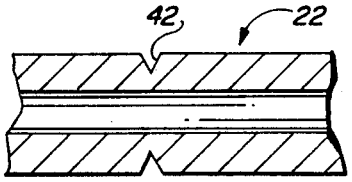
FIG. 5D

UNITARY CENTRIFUGE TUBE AND SEPARABLE DISPENSING RECEPTACLE

BACKGROUND OF THE INVENTION

1. Field of the Invention.

This invention relates to apparatus for medical test procedures and, more particularly, to a disposable one-piece centrifuge tube with a separable dispenser receptacle at the end of the centrifuge tube.

2. Description of the Related Art.

In medical diagnostic laboratory tests it is often desirable to centrifuge a liquid sample and examine with a microscope the heavier material which separates out under centrifugation. Urinalysis and hemanalysis are two examples of typical diagnostic tests in which such a procedure is desirable. Other processes of medical and biological research also require the separation of heavier components from a liquid by centrifugation. In many cases the final step of an analytical procedure involves examining the separated components on a slide under a microscope, sometimes after staining or some other type of treatment. It would be an extremely useful development in the art of microscopic examination of the sediment resulting from centrifugation of a liquid sample if there were available a convenient, disposable device in which the centrifuging of the sample can take place and which allows the resulting sediment to be conveniently manipulated and dispensed onto a microscope slide for specimen preparation and subsequent examination.

The standard technique of first mixing the sediment with some supernatant liquid to facilitate the transferral to a microscope slide and then pipetting the mixed sediment to the slide is overly time-consuming. Furthermore, the mixing and transferring steps make use of three different pieces of equipment in contact with the sediment (the centrifuge tube, the pipet, and the microscope slide), increasing the possibility of specimen contamination prior to examination.

One approach to the problem has been to design a combination centrifuge tube and microscope slide device which eliminates the need for a separate decanting of the sediment from a specimen after it has been centrifuged to collect the sediment. U.S. Pat. No. 4,066,414 to Selby discloses a one-piece tube and microscope slide device for use in clinical procedures employing a liquid test specimen. A normally upright tubular reservoir structurally equivalent to an ordinary test tube has a microscope slide chamber frangibly connected to its lower end. The slide chamber comprises closely spaced opposed planar walls of optically transparent material. A transition member between the tubular reservoir and the slide chamber has a bore to allow flow communication between the reservoir and the slide chamber. The device functions initially as a test tube to allow chemical analysis or specific gravity measurements to be initially made, and thereafter as a microscope slide after centrifugation and frangible detachment of the slide chamber from the reservoir tube.

U.S Pat. No. 3,814,522 to Clark et al is directed to a specimen tube open at its upper end and suitable for use in a centrifuge having a closed lower end which is flattened to define a reduced chamber portion for retaining a thin layer of sample for microscopic examination of the sediment within the flattened portion. The main body portion of the tube has a flat surface extending along a plane parallel with the flattened lower end portion of the tube.

U.S. Pat. No. 3,750,645 to Bennett et al is directed to a separator tube for separating serum or plasma from the cells in blood. A constriction divides the tube into two chambers and has an inside diameter sufficient to allow serum or plasma to pass but not so large as to prevent the formation of an "air lock" between the chambers when the tube containing the blood is held horizontally. After separation of the cells from the serum or plasma by settling or centrifugation, the tube is fractured at the constriction into two containers, one with only serum or plasma and the other with only cells. The container holding the serum or plasma can be closed with a stopper, cap, or sealing material and provided with various features to facilitate dispensing of the fluid portion.

U.S. Pat. No. 3,914,985 to von Behrens is directed to a device and method for harvesting, compacting, and measuring particulate matter suspended in liquids such as body fluids. The device comprises an outer tube closed at its lower end and containing a removable inner tube, the inner tube having an upper section defining an enlarged chamber and having a transparent lower section provided with a capillary passage communicating with the chamber. After particulate matter has collected in the capillary passage by centrifugation, the inner tube is removed and the lower capillary section is separated and is thereafter re-centrifuged at higher speed to compact the particulate matter for optical volumetric measurement. In one embodiment the lower end of the capillary tube is open and communicates directly with the interior of the outer tube so that during initial centrifugation an equilibrating flow of liquid and particulates takes place to displace from the inner tube substantially all but the uppermost strata of particulates.

Neither of the two devices disclosed by Clark et al and by Selby allows any type of treatment of the sediment produced in centrifugation before analysis under a microscope. Neither the blood separation methods disclosed by Bennett et al nor the device and method for harvesting, compacting, and measuring particulate matter disclosed by von Behrens provides a simple and convenient device and method for dispensing the heavier separated components of a centrifuged liquid sample without requiring additional components and manipulative steps. It would be a significant advance in clinical and research laboratory procedures if there were developed a unitary centrifuge tube having a smaller container at its lower end which could be separated from the main part of the tube and conveniently manipulated to dispense the enclosed sediment onto one or more microscope slides or into one or more test tubes for subsequent microscopic or chemical analysis.

SUMMARY OF THE INVENTION

A unitary centrifuge tube and separable sediment dispenser is provided which has the desirable characteristics described above. A main body portion is generally tubular with a diameter that tapers from a largest value at a first, open end to a smallest value close to an almost completely closed lower end. A small opening in the lower end communicates through a short connecting tube of small diameter with a sediment receptacle. The sediment receptacle is designed to be easily separated from the centrifuge tube after centrifugation by twisting the receptacle and centrifuge tube with respect to each other or otherwise severing the coupling between them. A short segment of the connecting tube which remains attached to the sediment container allows convenient dispensing of the enclosed sediment by squeezing a first pair of opposing walls of the receptacle. An opposed second pair of transverse sidewalls are designed so as to resist flexing during the separation procedure.

In a first embodiment of the unitary centrifuge tube and dispenser device, both pairs of sidewalls are planar and parallel. The interior spacing between one sidewall pair is substantially greater than the spacing between the second sidewall pair. The more narrowly separated sidewalls have greater surface area and flex more readily under pressure than the more widely separated sidewalls. The end of the sediment receptacle adjoining the connecting tube has sloping portions which provide a smooth transition from the bore of the connecting tube to the spacings of the opposed sidewall pairs. In another embodiment the large-area sidewalls are concave outward and the smaller-area sidewalls each have two planar facets consisting of narrow strips forming an outwardly convex dihedral angle. Each sidewall at its upper end adjoins a planar facet which slopes toward the connecting tube. Other alternative embodiments of the receptacle are characterized by designs which provide one opposed pair of sidewalls which resist flexing and a transverse pair of opposed sidewalls which are easily flexed. The stiffly opposed sidewalls are manipulated in separating the receptacle from the centrifuge tube, whereas the flexibly opposed sidewalls are utilized in dispensing controlled amounts of the contents through the stub of connecting tube left after separation from the centrifuge tube.

The unitary centrifuge tube and dispensing receptacle device can be cheaply and simply manufactured by either blow-molding or injection-molding of a suitable plastic. The plastic can be transparent to allow viewing of the contents. Various kinds of measuring marks can be molded into the surfaces of the centrifuge tube and the receptacle to allow quantitative filling of the centrifuge tube and dispensing of the contents of the receptacle.

BRIEF DESCRIPTION OF THE DRAWING FIGURES

A better understanding of the present invention may be realized from a consideration of the following detailed description, taken in conjunction with the accompanying drawing in which:

FIG. 1 is a top plan view of a unitary centrifuge tube and sediment dispenser in accordance with the present invention;

FIG. 2 is a side elevation view of the device shown in FIG. 1;

FIG. 3 is a perspective view of an alternative embodiment of the unitary centrifuge tube and separable sediment dispenser device;

FIG. 4 is a sectional view through the dispenser receptacle as indicated in FIG. 3; and FIGS. 5A–5D are sectional schematic views of the severable coupling between the tube and dispenser of FIG. 1.

DESCRIPTION OF THE PREFERRED EMBODIMENT

In accordance with the present invention a unitary centrifuge tube and separable dispensing receptacle device 10 is provided which is useful for medical and biological laboratory procedures. As shown in FIG. 1, device 10 comprises a generally tubular centrifuge tube 12 with a cross section that narrows from a maximum at an open top end 14 to a smaller value near a bottom end 16. Bottom end 16 of centrifuge tube 12 has a rounded portion 18 with a centrally located opening 20 that communicates through a connecting tube 22 with a dispensing receptacle 24. A pair of parallel planar opposed sidewalls 26 connect a generally flat bottom end 28 of receptacle 24 with a top end 30 comprising a plurality of sloping facets 32. Additional details of receptacle 24 are shown in FIG. 2, in particular a second pair of opposing sidewalls 34 which are transverse to sidewalls 26. Sidewalls 26 are spaced considerably further apart than are sidewalls 34.

Device 10 can be conveniently manufactured by either a blow-molding process or an injection-molding process starting with a raw material comprising a plastic which is suitable to the appropriate process. Fiducial marks can be molded into the exterior surfaces of centrifuge tube 12 and dispensing receptacle 24 during the manufacturing process to provide convenient means of quantitatively filling the centrifuge tube 12 and dispensing measured amounts of the contents of receptacle 24.

An alternative embodiment with a differently shaped dispensing receptacle 24' is illustrated in the perspective view of FIG. 3. A first pair of opposed sidewalls 26' is generally transverse to a second pair of opposed sidewalls 34'. Each sidewall 26' comprises two adjacent planar strips joined along a ridge line 36 to form a dihedral angle. The surface areas of sidewalls 34' are considerably larger than the surface areas of sidewalls 26'. Sidewalls 34' are curved and outwardly convex. They provide much less resistance to flexure upon application of forces normal to their surfaces than do sidewalls 26', which are relatively stiff. FIG. 4 is a cross-sectional view of dispensing receptacle 24' of the alternative embodiment. One of the primary considerations in the design of the dispensing receptacle 24 is to ensure that it can be manipulated in such a way as to separate it from centrifuge tube 12 without ejecting any of the contents of receptacle 24. Connecting tube 22 can have a structurally weakened portion centered along its length at which torsional failure will occur when tube 12 and receptacle 24 are twisted with respect to each other. Subsequent to separation of receptacle 24 from centrifuge tube 12, the sediment contained in receptacle 24 can be conveniently dispensed in a controlled manner by squeezing sidewalls 34' to expel the sediment through a stub of connecting tube which remains attached to receptacle 24.

FIGS. 5A–5D show a number of examples of how the connecting tube 22 may be provided with a structurally weakened portion to reduce the torsional force required for severing the tube 22 and concentrate it at the specific region of weakening. FIG. 5A shows a cross section of the coupling tube 22 provided with a notch 40 in the tube sidewall which results in a reduced cross-section of the tube sidewall at that point. The notch 40 is shown in FIG. 5A as providing a U-shaped, generally square-cornered, reduction in sidewall thickness. It may extend circumferentially around the tube 22 or it may be present at only a few points about the tube (like the two shown in FIG. 5A).

FIG. 5D shows a similar configuration in which a notch or ring 42 of reduced outer diameter is formed with a generally v-shaped notch which may extend about the tube 22.

In FIG. 5B the sidewalls 44 of the tube 22 are thinned by forming them with a gradual taper to a central point 46 where the walls 44 are the thinnest, this being the weakest point for severing the tube 22.

FIG. 5C shows the tube 22 with a structurally weakened portion 48 formed by the walls of the tube 22 being fabricated with a slight protuberance 50 along the outer wall surface, which may correspond to a circumferential ring on the inside of the tube 22 such that the walls of the tube are actually thinner at that point.

All of these examples of selective structural weakening of the tube 22 may be accomplished during the forming process. Other means of structurally weakening the tube 22 may be performed by resort to scoring, grinding or cutting implements, but these usually require additional fabrication steps and tend to unduly complicate the fabrication process with a resulting increase in cost. Such are generally to be avoided in a disposable device which is to be made in very large quantities at as low a cost as may be realized.

The unitary centrifuge tube and separable dispensing receptacle 10 of the present invention allows the heaviest components in a liquid sample to be centrifuged into a receptacle which can then be easily detached and used to dispense the separated components without any intermediate handling steps or the use of any auxiliary components or devices. Thus, for example, multiple slides can be prepared from a single centrifuge sample and specialized slide preparation techniques can be employed before microscopic examination of the slides takes place. If necessary, the stub of connecting tube 22 remaining after separation of receptacle 24 from centrifuge tube 12 can be sealed for purposes of transport, environmental treatment, or storage. Any type of simple stopper known in the art can be used. If the device 10 is made of a thermoplastic, the end of the stub of connecting tube 22 can be heat sealed to isolate the contents of receptacle 26.

In using the unitary centrifuge tube and separable dispensing pipet 10, a liquid sample is centrifuged in the unit. After the centrifuging step, the pipet portion is rotated relative to the centrifuge tube portion about the central axis of the connection between the centrifuge tube portion and the pipet. This may be done manually by holding the centrifuge tube in one hand, grasping the opposed sidewalls of the pipet in the other hand and twisting one with respect to the other. After the two portions are separated, the opening of the pipet may be placed above a microscope slide, for example, and contents of the pipet may be emitted onto the slide by squeezing the pair of resiliently flexible opposed sidewalls of the pipet. In this manner, all intermediate handling steps between placing the specimen in the centrifuge tube and dispensing the centrifuged sediment from the pipet in which the centrifuged sediment is deposited are dispensed with.

Although there have been shown and described hereinabove specific arrangements of a unitary centrifuge tube and separable dispensing receptacle device in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. A unitary centrifuge tube and sediment dispensing pipet device comprising:

a centrifuge tube member open at a top end and having a cross-sectional area decreasing toward a bottom end which has an opening therein;

a dispensing pipet having an opening at a top end and being closed at a bottom end and having a first pair of spaced-apart sidewalls which are closer together than a second pair of spaced-apart sidewalls which are generally transverse to said first pair, said first pair of sidewalls being resiliently flexible and said second pair of sidewalls being relatively non-resilient; and severable flow path means coupling said bottom end of said centrifuge tube member to said top end of said pipet;

a portion of said flow path means comprising means for facilitating the separation of said pipet from said centrifuge tube member at a selected location along said flow path means;

wherein said first pair of sidewalls are outwardly convex and each of said second pair of sidewalls comprises two planar surfaces meeting along a central line to form an outwardly convex dihedral angle.

2. The device of claim 1 wherein a combined surface area of said first pair of sidewalls is substantially greater than a surface area of said second pair of sidewalls.

3. The device of claim 1 wherein said device is molded of a plastic material.

4. The device of claim 1 wherein said first pair of sidewalls are outwardly convex and said second pair of sidewalls are substantially planar and parallel to each other.

5. The device of claim 1 wherein said flow path means comprise a connecting tube having an interior and an exterior surface, said connecting tube being formed to promote severing at a selected location such that, when severed, a portion of said connecting tube remains attached to said pipet to constitute a dispensing nozzle.

6. The device of claim 5 further comprising means for sealing an open end of said portion of connecting tube attached to said pipet after separation from said centrifuge tube member.

7. The device of claim 5 wherein said top end of said pipet comprises a plurality of planar surfaces sloping from said first and second pairs of sidewalls toward said connecting tube.

8. The device of claim 5 wherein said facilitating means comprise means constituting part of said device for structurally weakening said connecting tube in the vicinity of said selected location.

9. The device of claim 8 wherein said structurally weakening means comprise means defining an internal notch extending about the interior surface of said connecting tube.

10. The device of claim 8 wherein said structurally weakening means comprise a portion of said connecting tube having thinner walls than the remainder of said connecting tube.

11. The device of claim 8 wherein said structurally weakening means comprise means defining a notch in said exterior surface of the connecting tube.

12. The device of claim 11 wherein said notch is generally U-shaped and extends at least partially about said connecting tube.

13. The device of claim 11 wherein said notch is V-shaped and extends at least partially about said connecting tube.

14. The device of claim 11 wherein said notch extends circumferentially about said connecting tube.

* * * * *